United States Patent [19]

Spiller

[11] Patent Number: 4,472,888

[45] Date of Patent: Sep. 25, 1984

[54] COANDA EFFECT NOZZLE FOR HANDLING CONTINUOUS WEBS

[75] Inventor: Anthony K. Spiller, Finchampstead, England

[73] Assignee: Cary Metal Products, Inc., Barrington, Ill.

[21] Appl. No.: 385,045

[22] Filed: Jun. 4, 1982

[51] Int. Cl.[3] ..... F26B 13/20

[52] U.S. Cl. ..... 34/156; 34/160; 226/97; 239/DIG. 7

[58] Field of Search ..... 34/155, 156, 160; 226/7, 97; 239/DIG. 7, 53.3

[56] References Cited

U.S. PATENT DOCUMENTS

| | | | |
|---|---|---|---|
| 3,549,070 | 12/1970 | Frost et al. | 226/97 |
| 3,587,177 | 6/1971 | Overly | 34/156 |
| 3,711,960 | 1/1973 | Overly | 34/156 |
| 3,873,013 | 3/1975 | Stibbe | 226/97 |
| 4,271,601 | 6/1981 | Koponen | 34/156 |
| 4,274,210 | 6/1981 | Stengard | 34/156 |

FOREIGN PATENT DOCUMENTS

| | | | |
|---|---|---|---|
| 1585096 | 2/1981 | United Kingdom | 34/156 |

*Primary Examiner*—Larry I. Schwartz
*Attorney, Agent, or Firm*—McDougall, Hersh & Scott

[57] ABSTRACT

A Coanda effect nozzle includes first and second longitudinal airfoils mounted in spaced apart relationship generally transverse to the travel of the web. A mechanism is mounted between the first and second airfoils to define orifices adjacent each of the airfoils, so as to create first and second Coanda streams of air along the first and second airfoils, respectively. The first stream of air travels in a direction opposite to the travel of the second stream of air. The first and second streams of air travel generally parallel to the web.

13 Claims, 10 Drawing Figures

COANDA EFFECT NOZZLE FOR HANDLING CONTINUOUS WEBS

BACKGROUND OF THE INVENTION

This invention is directed to nozzles utilizing the so-called Coanda effect which control and float a moving web such as paper on streams of air produced by the nozzles. The present invention more specifically relates to web dryers having a plurality of nozzles arranged to produce Coanda air streams which dry wet ink printed on the web and support the continuous web as it moves through the dryer.

The nozzle of the present invention is particularly, but not exclusively, suited for use in a web dryer. For example, nozzles according to this invention could be generally employed for continuous web handling or routing such as in a conveyor.

Conventional web dryers provide a pressurized source of heated air which is applied by means of a plurality of spaced apart nozzles to a moving web of material such as paper having wet ink imprinted thereon. It is generally known that nozzles can function as a means for supporting, i.e., carrying the continuously running web through the dryer.

PRIOR ART

It is known in the art to employ nozzles utilizing the Coanda effect in web dryers. U.S. Pat. Nos. 3,587,177 and 3,711,960 are exemplary of such nozzles utilized in web dryers. These nozzles utilize a single airfoil for producing a single stream of air contiguous to the airfoil.

Nozzles are disclosed in U.S. Pat. Nos. 3,549,070 and 3,873,013 which use a single airfoil with an orifice at each edge to induce two streams of air which converge at the center of the airfoil.

A web dryer having a plurality of horn shaped nozzles is disclosed in U.S. Pat. No. 4,271,601.

SUMMARY OF THE INVENTION

The general purpose of the present invention is to provide an improved Coanda effect nozzle for use in web dryers or the like which achieve high operating efficiencies thereby minimizing the input energy requirements.

It is an object of the present invention to provide a Coanda effect nozzle having good web stabilizing and drying characteristics.

To achieve the above and other objects of the invention, a nozzle embodying the concept of the present invention is primarily defined by first and second longitudinal airfoils mounted in spaced apart relationship generally transverse to the travel of the web, and a means mounted between the first and second airfoils for defining orifices along the adjacent edge of each airfoil so as to create first and second streams of air along the first and second airfoils, respectively, wherein the second stream of air is traveling in a direction opposite to that of the first stream of air. The nozzle includes an air duct for receiving air from a pressurized source of air.

DETAILED DESCRIPTION

Figure 1:
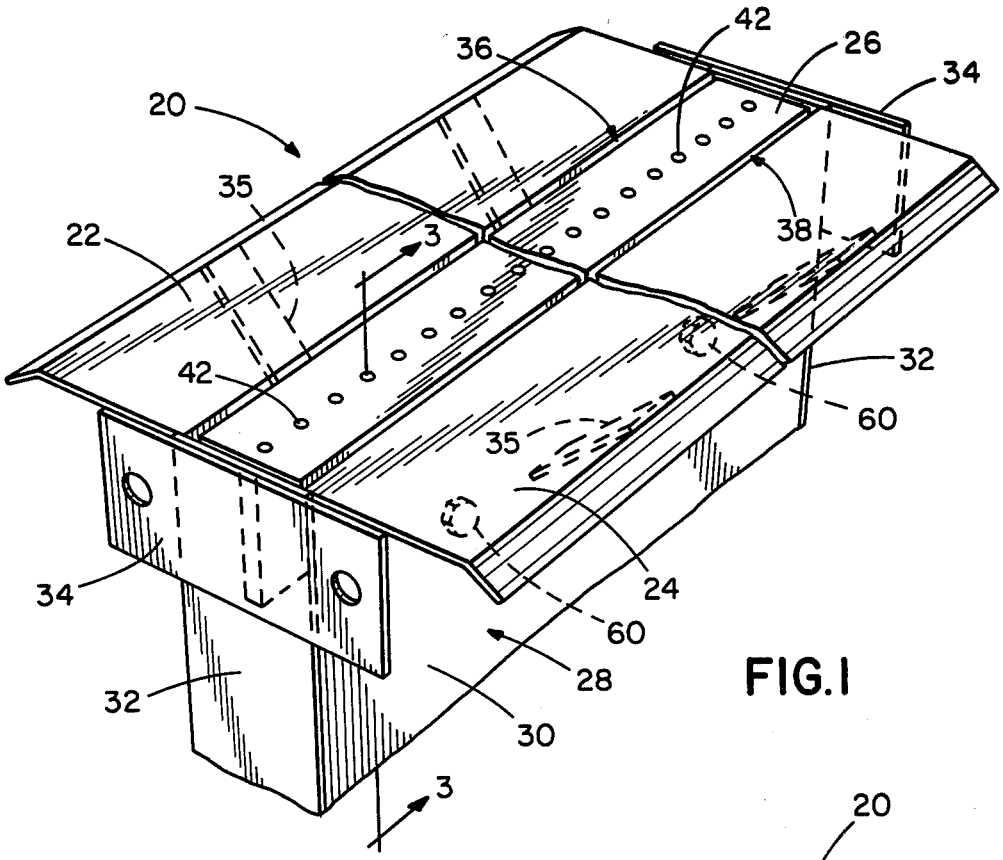
FIG. 1 is a perspective view of a nozzle according to the present invention shown foreshortened.
Figure 2:
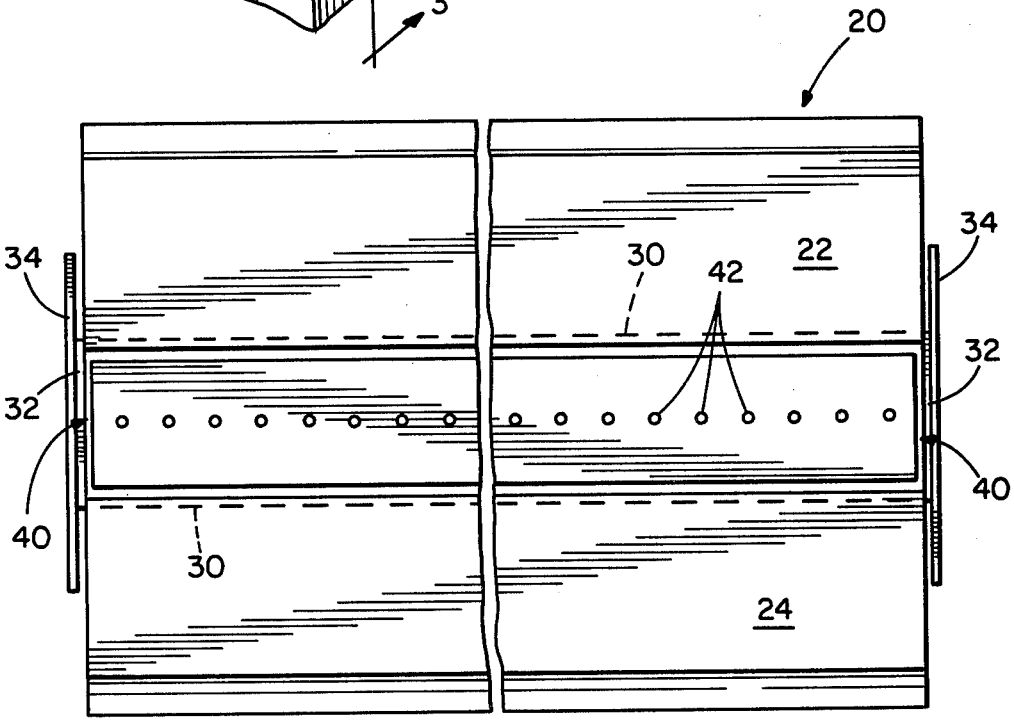
FIG. 2 is a top plane view of the nozzle as shown in FIG. 1.
Figure 3:
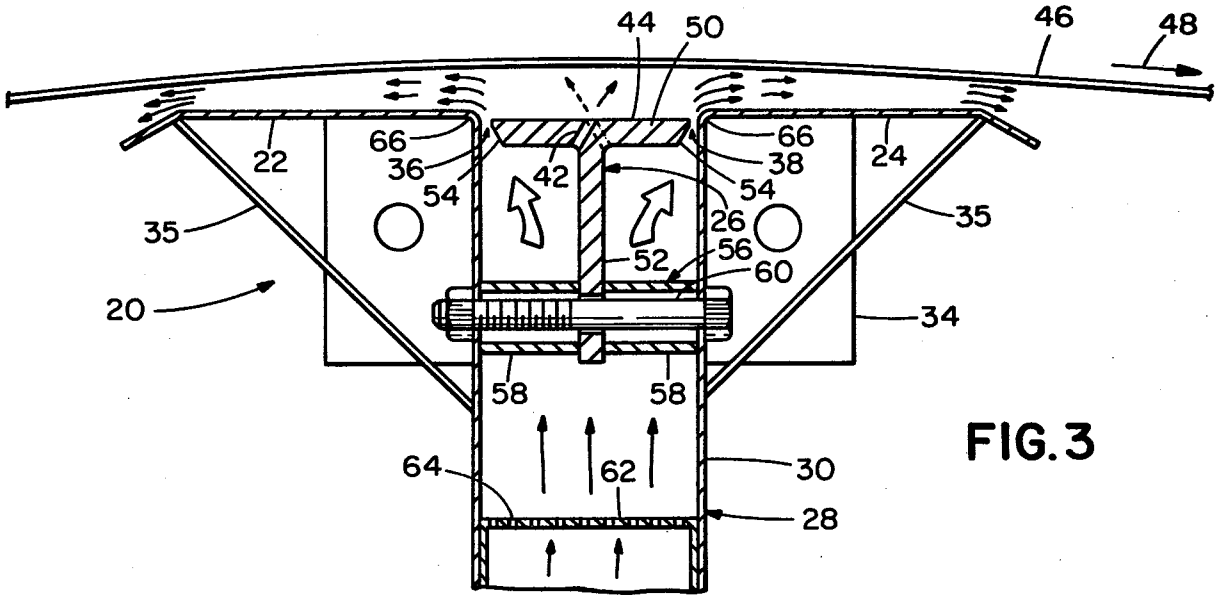
FIG. 3 is a cross-sectional view taken about line 3—3 of FIG. 1 in which a web is shown being carried by the nozzle.

In FIGS. 1–3, a nozzle 20 according to the present invention includes spaced apart longitudinal airfoils 22 and 24 and an orifice defining member 26 disposed therebetween. An air duct 28 having side walls 30 and end walls 32 connect the nozzle to a source of pressurized air such as by a conventional manifold distributing system (not shown). Mounting brackets 34 which are secured to each end of the nozzle, such as by welding, provide an easy and convenient means for mounting the nozzle to frame members of a web dryer. Reinforcing arms 35 may be mounted to the airfoils and the duct to help support the airfoils and maintain same in the desired orientation.

Longitudinal orifices 36 and 38 are defined between airfoil 22 and member 26, and between airfoil 24 and member 26, respectively. These orifices serve as the primary means by which air escapes from duct 28. Additional orifices 40 may be defined between the ends of member 26 and the end walls 32 of the duct. As seen in FIG. 3, spaced apart apertures 42 in member 26 are dimensioned to permit a predetermined amount of air to flow into the space defined between the upper surface 44 of member 26 and web 46. The web 46 is moving from left to right as indicated by arrow 48.

The orifice defining member 26 is longitudinally coextensive with the airfoils and has a generally T-shaped cross-section with a top element 50 and a base element 52. The edges 54 of top element 50 cooperate with airfoils 22 and 24 to define orifices 36 and 38, respectively. A portion of the edges may be inwardly beveled generally toward the base to enhance the desired fluid flow through the orifices. Member 26 may be mounted to the duct 28 by means of spacers 56 disposed at intervals along the duct and may include sleeves 58 mounted between base 52 and side walls 30 of the duct. A bolt 60 extending through the sleeves and through aligned holes in the walls 30 and in the base secures the T-shaped member 26 to the duct. Preferably, the spacers 46 are mounted a sufficient distance away from the orifices to minimize any disruption to the fluid flow at the orifices.

As shown in FIG. 3, the airfoils and side walls of the duct may be integrally formed from a suitable material such as sheet metal. The spacer 56, in addition to mounting member 26 to the duct, also provides a reinforcement to maintain a stable position of the airfoils. An inverted U-shaped spacer 62 having a plurality of holes 64 may be mounted between the side walls of the duct to provide additional reinforcement while still permitting the desired flow of air as generally indicated by the arrows in FIG. 3.

In the operation of nozzle 20, the radius 66 defines the beginning of airfoils 22 and 24 and is selected to give rise to the so-called Coanda effect. As seen in FIG. 3, air exiting orifice 36 flows generally right to left adjacent airfoil 22 and air exiting orifice 38 flows generally left to right adjacent airfoil 24 as illustrated by the arrows in FIG. 3. Web 46 floats above the airfoils upon a cushion of air formed by these air streams. The web is bowed slightly outwardly away from the top element 50 of member 26 due to the air flow induced in this area by holes 42. The distal edges of airfoils 22 and 24 may be bent at a slight incline generally away from web 46 to direct a portion of the discharged air away from the web.

To produce the Coanda effect, it is preferred that edges 54 terminate slightly below the plane defined by airfoils 22 and 24. This causes the orifices 36 and 38 to terminate generally at the beginning of radius 66 of the airfoils. This orientation promotes the desired Coanda effect, i.e., the flow of air whereby the air generally flows parallel and adjacent a curved or inclined surface.

One of the advantages of the present invention is that each nozzle initially presents to the web a stream of air flowing in a direction opposite to the travel of the web regardless of the direction of travel of the web. This tends to break down the boundary air layer adjacent the moving web at or beyond the edge of the airfoil surface. The velocity of the Coanda air streams is greatest adjacent large radius 66 and decreases to a lesser velocity at the distal edge of each airfoil. Because the boundary layer associated with the web is disrupted by the lower velocity air adjacent the edge of the airfoil, this permits the higher velocity air adjacent the beginning of the airfoil to achieve more effective engagement with the surface of the web thereby maximizing heat transfer and drying of wet ink printed on the web. Furthermore, it is believed that the reversal of air flow at the point of maximum air velocity, i.e., at the orifices of the nozzle, creates an effective condition which facilitates drying of ink of the web.

Another advantage of the nozzle of the present invention is that the back-to-back structure of orifices and airfoils defines a closed system which prevents the undesired entrainment of cooler ambient air in the web dryer with the heated air delivered by the ducts to the orifices. In conventional longitudinal nozzles mounted transverse to the travel of the web, there is no provision to prevent cooler ambient air from being sucked into and combining with the air jet created by the orifices at the beginning of the airfoil. Such a mixing of cool air with the heated air from the orifices reduces the average temperature of the stream of air thereby lowering its drying efficiency.

Figure 4:
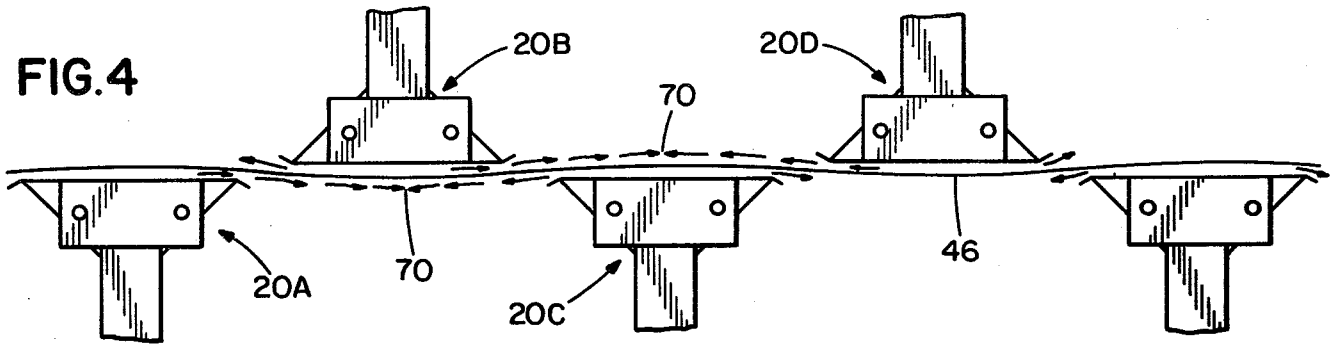
FIG. 4 is a diagramatic view of a dryer employing nozzles according to the present invention in spaced apart relationship on both sides of a continuously running web.

The diagram shown in FIG. 4 illustrates an arrangement of nozzles of the present invention in a dryer having web 46 moving therethrough. The nozzles are preferably located on both sides of the web in alternating spaced apart relationship. The air stream between adjacent nozzles 20A and 20C and between nozzles 20B and 20D is such that the air streams collide at 70 to create turbulence opposite the nozzles on the other side of the web. Such collisions are helpful in disruption of the boundary air layers adjacent the web. Because the collisions of the air streams occur opposite the nozzles on the other side of the web, the flotation forces generated by each nozzle are not significantly offset by counteracting forces due to air flows on the other side of the web.

FIGS. 5–10 illustrate other embodiments of the present invention having various constructional differences from that of nozzle 20 shown in FIGS. 1–3. Only the significant features or differences of each embodiment are illustrated in order to emphasize such differences and features. The position in which the web is held or carried by these embodiments is exaggerated for clarity.

Figure 5:
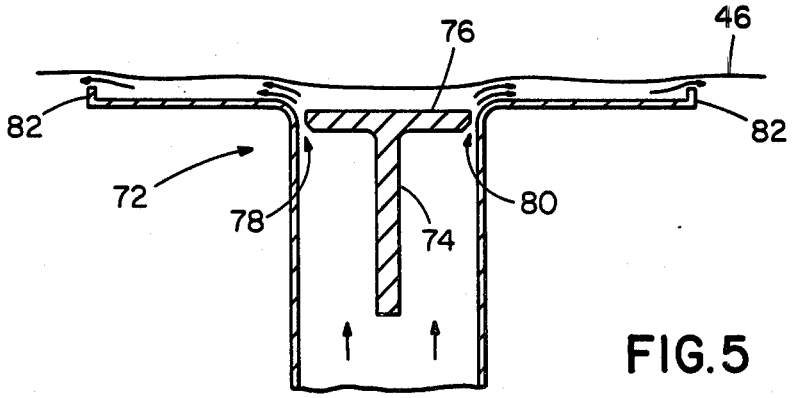
FIGS. 5–10 are simplified cross-sectional views of nozzles of differing construction according to the concepts of the present invention.

Nozzle 72 of FIG. 5 generally differs in two significant respects from nozzle 20. First, the orifice defining member 74 does not include holes 42 as did member 26. A suction is created in the region between web 46 and the surface 76 of member 74 because the orifices of nozzle 72 are discharging air moving in diverging directions. Thus, a partial vacuum or subatmospheric pressure exists in this region which tends to pull web 46 slightly closer to member 76 than its distance relative to the airfoils.

The subatmospheric pressure generated by nozzle 72 is believed to provide an advantage in addition to those advantages disclosed with respect to nozzle 20 in that higher dryer efficiencies can be attained. This result is achieved because more solvent vapor associated with the ink will evaporate at a lower pressure than at a higher pressure for a given temperature. Thus, the creation of a low pressure area is believed to be beneficial to drying ink on the web. The position of the lower pressure area is believed to be especially advantageous with the nozzle of the present invention in that it occurs between the points of maximum heat transfer, that is, at orifices 78 and 80. Thus, the maximum point of heat transfer and the low pressure area synergistically cooperate to achieve higher drying efficiency.

The airfoils of nozzle 72 differ from the airfoils of nozzle 20 in that these airfoils are generally co-planar except for the distal edges 82 thereof which define flanges turned substantially at a right angle to the plane of the airfoil and extend towards web 46. These flanges influence the discharge of air from the airfoil such that web 46 tends to hover a greater distance away from the general plane of the airfoil than would occur, if the edges were straight or bent away from the web.

Figure 6:
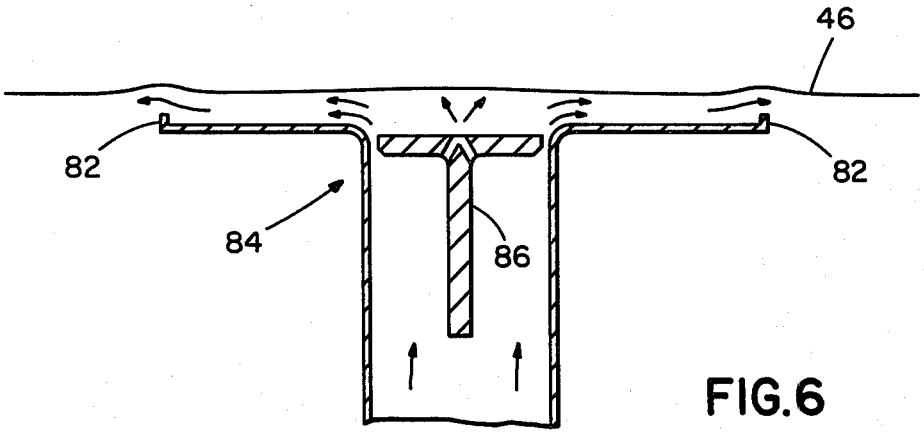

In FIG. 6, the airfoils are identical to those of nozzle 72 shown in FIG. 5. The orifice defining member 86 is substantially similar to that utilized in nozzle 20 in that it includes alternating holes which permit a discharge of air opposite the orifice defining member toward the web therein preventing a partial vacuum from being formed.

Figure 7:
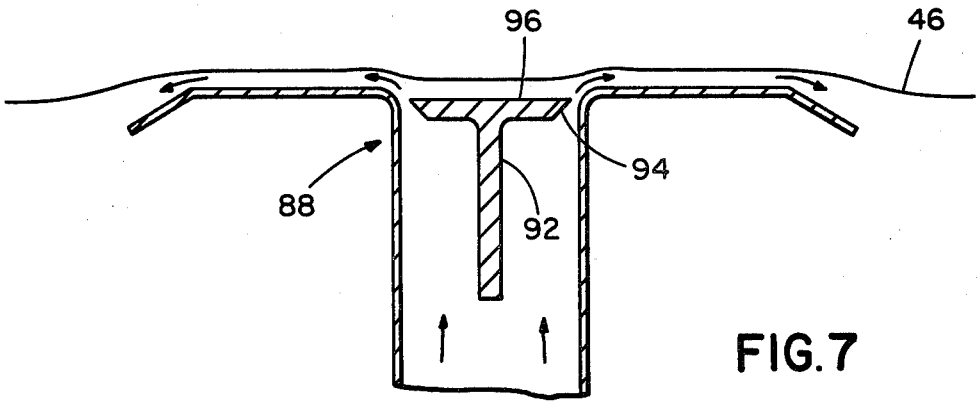
Figure 8:
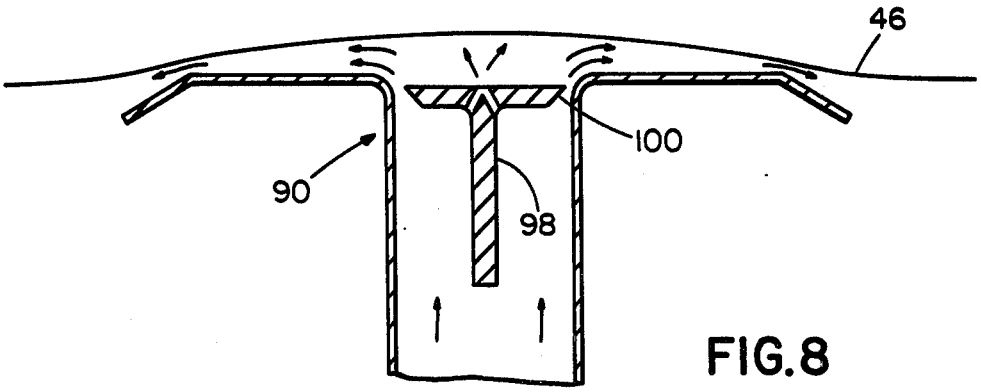

FIGS. 7 and 8 illustrate nozzles 88 and 90, respectively, each having airfoils substantially identical to that previously shown and discussed with respect to nozzle 20 shown in FIGS. 1–3. The orifice defining member 92 of nozzle 88 is similar to that of FIG. 5 in that no holes are provided such that a partial vacuum is formed between the top of member 92 and web 46 as previously described. It will be noted that the edges 94 of orifice defining member 92 are beveled inwardly so as to define a knife edge (acute angle) adjacent the upper surface 96 thereof. The orifice defining member 98 in nozzle 90 includes holes therethrough similar to such members previously described. The edges 100 are beveled in a similar manner to edges 94 of nozzle 88. The web is generally concave adjacent member 92 in nozzle 88 and convex adjacent member 98 in nozzle 90.

Figure 9:
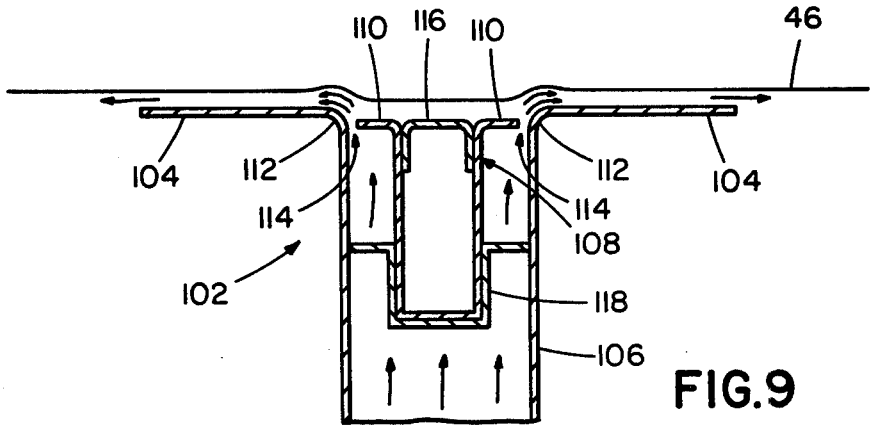

In FIG. 9, nozzle 102 includes co-planar airfoils 104, air duct 106, and orifice defining member 108. In this embodiment, the member 108 comprises a longitudinal element formed from sheet metal having a generally U-shaped cross-section in which the distal edges are turned outwardly to define flanges 110 which terminate adjacent radii 112 of the airfoil to define longitudinal orifices 114. A longitudinal reinforcing member 116 having a generally inverted U-shape is mounted between the legs of member 108 adjacent flanges 110 to reinforce and maintain the spacing of the flange members and hence the dimensional characteristics of the orifices. A plurality of spaced apart hangers 118 are attached by conventional means to the duct 106 to support member 108 within the duct work. The hangers are preferably disposed so as to provide a minimum disruption to the flow of air through duct 106 especially near the orifices.

In nozzle 102, a partial vacuum is created intermediate the orifices in a similar manner to that described for the nozzles illustrated in FIGS. 5 and 7. Because the edges of airfoils 104 terminate in the same plane as the remainder of the airfoil in a configuration which does not create a substantial Coanda effect flow, the air flowing adjacent the airfoil and web tends to continue flowing parallel to the web as it exits beyond the airfoil.

Figure 10:
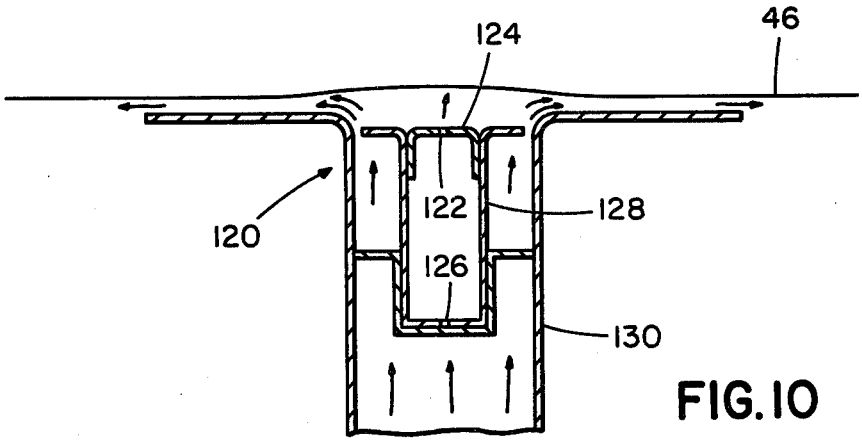

Nozzle 120 in FIG. 10 is substantially identical in construction to that of nozzle 102 in FIG. 9 with the exception of spaced apart holes 122 in reinforcing member 124 and spaced apart holes 126 in orifice defining member 128. These holes permit air flowing through duct 130 to exit hole 122 to impinge upon web 46 to defeat or prevent the partial vacuum which would otherwise be formed in this region. This causes the web to ride slightly further away from member 128 than does the web with respect to member 108 in nozzle 102. The nozzles shown in FIGS. 9 and 10 are more easily constructed since the orifice defining structure may be formed from sheet metal as opposed to manufacturing a T-shaped member as illustrated in other embodiments.

It will be apparent to those skilled in the art in view of this teaching that nozzles contemplated by this invention can be constructed utilizing orifice defining members of various types of construction. Also, it is possible to supply air independently to each orifice by using separate ducting for each.

Although embodiments of the present invention have been described above and illustrated in the drawings, the scope of the present invention is defined by the claims appended hereto.

What is claimed is:

1. In a system for floating a continuous traveling web by means of nozzle positioned generally transverse thereto, said system including a source of pressurized air fed to the nozzles, air exiting from the nozzles being divided into first and second Coanda air streams, the first stream traveling generally opposite in direction to the travel of the second stream with both streams traveling generally parallel to the direction of web travel, the improvement wherein a nozzle in the system comprises:

(a) first and second, spaced-apart, longitudinal air foils disposed transverse to the direction of travel of the web; and, (b) a member located in the space defined between said first and second air foils, said member defining distal edges located in spaced relationship with respective edges of said air foils for thereby defining first and second longitudinal orifices for the discharge of said first and second air streams, and including openings defined by said member for introducing a predetermined air flow intermediate said first and second air streams, said air flow impinging upon said web to provide pressure for insuring movement of said web above the nozzle and out of contact with the nozzle.

2. The apparatus according to claim 1 wherein nozzles are located in spaced relationship on both sides of the traveling web, the positions of the nozzles on one side of the web alternating with the positions of the nozzles on the opposite side of the web.

3. The apparatus according to claim 1 wherein said first and second airfoils and said member defining means are configured such that when the web is in an operative position relative thereto said first and second Coanada streams produce a partial vacuum intermediate said first and second airfoils thereby facilitating the drying of said web.

4. The apparatus according to claim 1 wherein said member defining means comprises a longitudinal generally T-shaped member having a top element adjacent said web and a base member intermediate said top member, the distal edges of said top member cooperating with said first and second airfoils to define said first and second orifices, respectively.

5. The apparatus according to claim 4 wherein the distal edges of said top element lie below a radius defining the beginning of said first and second airfoils, respectively.

6. The apparatus according to claim 1 wherein said member defining means comprises a longitudinal element formed from sheet metal having first and second edges disposed adjacent said first and second airfoils, respectively, to define said first and second orifices.

7. The apparatus according to claim 1 further comprising a duct for directing air to said first and second orifices.

8. The apparatus according to claim 7 wherein one wall of said duct and said first airfoil are integrally formed from a single sheet of sheet metal, and another wall of said duct and said second airfoil are integrally formed from a single sheet of sheet metal.

9. The apparatus according to claim 1 further comprising means for forming a third orifice adjacent one end of said member and for forming a fourth orifice adjacent the other end of said member whereby air exiting said third and fourth orifices impinges upon said web to assist in supporting the latter.

10. The apparatus according to claim 1 wherein distal portions of said first and second airfoils each comprise an inclined surface sloping generally away from said web.

11. The apparatus according to claim 1 wherein distal portions of said first and second airfoils each comprise surface lying in the same plane as an intermediate portion of said first and second airfoils, respectively.

12. The apparatus according to claim 1 wherein distal portions of said first and second airfoils each comprise outwardly turned flanges projecting generally towards said web.

13. The apparatus according to claim 1 further comprising at least first and second nozzles spaced apart on one side of said web, said first Coanda air stream of said first nozzle directed toward said second nozzle and said second Coanda air stream of said second nozzle directed toward said first nozzle wherein said first Coanda air stream of said first nozzle collides with said second Coanda air stream of said second nozzle intermediate said first and second nozzle to inhibit the entrainment of said first Coanda air stream within said second nozzle.

* * * * *